US011662679B2

(12) United States Patent
Obata

(10) Patent No.: US 11,662,679 B2
(45) Date of Patent: May 30, 2023

(54) IMAGE HEATING APPARATUS AND IMAGE FORMING APPARATUS

(71) Applicant: Canon Kabushiki Kaisha, Tokyo (JP)

(72) Inventor: Seiji Obata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/242,683

(22) Filed: Apr. 28, 2021

(65) Prior Publication Data

US 2021/0333735 A1 Oct. 28, 2021

(30) Foreign Application Priority Data

Apr. 28, 2020 (JP) ..... JP2020-079239

(51) Int. Cl.
*G03G 15/20* (2006.01)

(52) U.S. Cl.
CPC ..... *G03G 15/2064* (2013.01); *G03G 15/2053* (2013.01); *G03G 2215/2038* (2013.01)

(58) Field of Classification Search
CPC ..... G03G 15/80; G03G 15/2017; G03G 15/2053; G03G 15/2064; G03G 21/1652; G03G 2215/2003; G03G 2221/166
See application file for complete search history.

(56) References Cited

U.S. PATENT DOCUMENTS 10,983,463 B2 4/2021 Shimura et al.
2011/0069985 A1 3/2011 Mizumo
2013/0302060 A1* 11/2013 Moriya ..... G03G 15/80 399/90
2015/0139708 A1* 5/2015 Shimura ..... G03G 15/2053 399/329
2020/0401070 A1* 12/2020 Sekimizu ..... G03G 15/2053

FOREIGN PATENT DOCUMENTS

EP 2874017 A1 5/2015
JP 2001272811 A 10/2001
JP 2013235769 A 11/2013
JP 2017054071 A 3/2017
JP 2017062461 A 3/2017

OTHER PUBLICATIONS

Extended European Search Report dated Aug. 18, 2021 in counterpart European Patent Appln. No. 21170359.0.

* cited by examiner

*Primary Examiner* — Thomas S Giampaolo, II
(74) *Attorney, Agent, or Firm* — Venable LLP

(57) ABSTRACT

An image heating apparatus includes a first rotating member, a second rotating member to form a nip portion which sandwiches a recording material between the first rotating member and the second rotating member, a heater unit provided inside the first rotating member and having a heater for heating an image on the recording material sandwiched by the nip portion, and a sheet member provided to overlap a part of the heater and electrically connected to the heater. The sheet member includes a first sheet member connected to one end of the heater in a longitudinal direction of the heater and a second sheet member connected to the other end of the heater, the first sheet member extends from the one end of the heater in a direction crossing the longitudinal direction, and the second sheet member extends from the other end of the heater in the longitudinal direction.

19 Claims, 7 Drawing Sheets

IMAGE HEATING APPARATUS AND IMAGE FORMING APPARATUS

BACKGROUND OF THE INVENTION

Field of the Invention

The present invention relates to an image heating apparatus such as a fixing apparatus provided in an electrophotographic-recording image forming apparatus such as a copier and a printer, and a gloss applying device which improves the glossiness of a toner image fixed to a recording material by reheating the toner image.

Description of the Related Art

One form of a fixing apparatus mounted in an image forming apparatus such as a copier and a printer has a cylindrical film which transfers heat to a recording material, a heater which has a ceramic substrate having a heat-generating resistor thereon and which is provided in contact with the inner surface of the film, and a roller which forms a nip portion together with the heater via the film. The fixing apparatus has a roller driven to rotate by driving unit such as a gear provided at one end of the roller, and the film is driven to rotate while sliding on the heater. A configuration is proposed for such a fixing apparatus, in which the heat-generating region of the heater is divided into a plurality of regions in the longitudinal direction of the heater, a thermistor as a temperature detecting element is formed on the substrate for each of the heat-generating regions, and a temperature is detected for each of the heat-generating regions (Japanese Patent Application Publication No. 2017-054071).

SUMMARY OF THE INVENTION

The heater disclosed in Japanese Patent Application Publication No. 2017-054071 includes a plurality of conductors each connected to each temperature detecting element and a plurality of electric contacts connected to a plurality of conductors respectively. The plurality of electric contacts are connected to a control substrate by electric wires. When a flexible sheet such as an FPC (Flexible Printed Circuit) and an FFC (Flexible Flat Cable) is used as electric wiring for electrical connection to the plurality of electric contacts of the heater, electric wire routing can be easily carried out. Therefore, improvement of assembling of the fixing apparatus can be expected.

The flexible sheet may be extended from the electric contact at the heater end to the control substrate in a direction same as the longitudinal direction of the heater. However, since the driving unit is provided at one end of a roller, the driving unit has to be apart from the heater end and the flexible sheet in order to prevent the flexible sheet and the driving unit from contacting each other. In this case, the size of the fixing apparatus increases in the longitudinal direction of the heater, which may increase the size and cost of the apparatus.

When a support component or a heater connected with the flexible sheet is inserted into the cylindrical film, the inside of the film and the flexible sheet may come into contact with each other and can be damaged.

It is an object of the present invention to provide a configuration which can prevent damage to a sheet member such as a flexible sheet and a film without increasing the size of an apparatus.

In order to achieve the above object, an image heating apparatus for heating an image formed on a recording material, according to the present invention includes a first rotating member;

a second rotating member provided in contact with an outer surface of the first rotating member to form a nip portion which sandwiches the recording material between the first rotating member and the second rotating member;

a heater unit provided inside the first rotating member and having a heater for heating the image formed on the recording material sandwiched by the nip portion; and a flexible sheet member including a flexible printed circuit or a flexible flat cable provided to overlap a part of the heater and electrically connected to the heater, wherein the flexible sheet member includes a first flexible sheet member connected to one end of the heater in a longitudinal direction of the heater and a second flexible sheet member connected to the other end of the heater, wherein the first flexible sheet member extends from the one end of the heater in a direction crossing the longitudinal direction, and wherein the second flexible sheet member extends from the other end of the heater in the longitudinal direction.

In order to achieve the above object, an image forming apparatus according to the present invention includes an image forming portion which forms an image on a recording material, the image forming portion includes a photosensitive member, a charging device for charging the photosensitive member, a scanner unit for scanning the photosensitive member with a light in accordance with an image information, a developing device for developing an electrostatic latent image formed on the photosensitive member with toner, and a transfer unit for transferring the image to the recording material; and a fixing portion which fixes an image, formed by the image forming portion, on the recording material, wherein the fixing portion is the image heating apparatus according of the present invention.

According to the present invention, damage to a sheet member such as a flexible sheet connected to a heater and a film can be prevented without increasing the size of the apparatus.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

General Structure of Image Forming Apparatus

Figure 1:
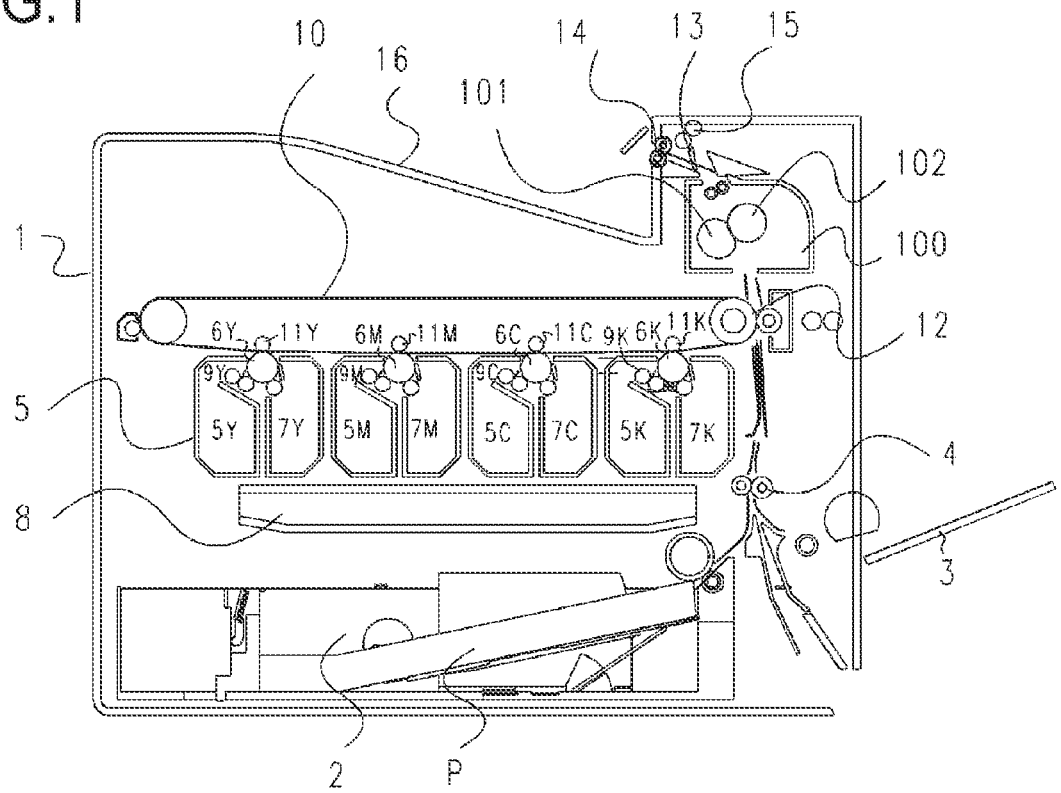
FIG. 1 is a sectional view of a general structure of an image forming apparatus to which the present invention can be applied.

FIG. 1 is a view (a longitudinal section) of an exemplary electrophotographic image forming apparatus according to an embodiment of the invention. The present invention is applicable to printers and copiers based on electrophotographic and electrostatic recording methods, and an example of application of the invention to a laser printer will be described.

A cassette 2 is retractably stored at the lower part of a printer 1. A manual paper feed portion 3 is provided on the right side of the printer 1. Recording materials P are loaded and stored at the cassette 2 and the manual paper feed portion 3. The loaded recording materials P are separated on a sheet basis and fed to resist rollers 4. The printer 1 includes an image forming portion 5 including transversely aligned image forming stations 5Y, 5M, 5C, and 5K corresponding to yellow, magenta, cyan, and black.

The image forming portion 5 includes photosensitive drums 6Y, 6M, 6C, and 6K (hereinafter collectively referred to as photosensitive drums 6) as image bearing members and charging devices 7Y, 7M, 7C, and 7K which uniformly charge the surfaces of the photosensitive drums 6. The apparatus also includes a scanner unit 8 which performs laser beam irradiation on the basis of image information to form an electrostatic latent image on a photosensitive drum 6, and developing devices 9Y, 9M, 9C, and 9K which develop toner images by sticking toner to the electrostatic latent image. Primary transfer portions 11Y, 11M, 11C, and 11K (hereinafter collectively referred to as primary transfer portions 11) are provided to transfer the toner images on the photosensitive drums 6 to an electrostatic transfer belt 10. The toner images transferred on the transfer belt 10 by the primary transfer portions 11 are transferred to the recording material P by a secondary transfer portion 12. Then, when passing through a fixing apparatus (an image heating apparatus) 100 as the fixing portion (the image heating portion), the transferred images are conveyed while being sandwiched and heated between a heating unit 101 and a pressure roller 102 in pressure-contact with the heating unit 101 and fixed on the recording material P. Thereafter, the conveyance path is arbitrarily switched by a double-sided flapper 13, and the material is conveyed to a pair of discharge rollers 14 or a pair of reverse rollers 15. The recording material P conveyed to the side of the reverse rollers 15 is reversed and conveyed by the reverse rollers 15 in prescribed timing to pass between the resist rollers 4 and the secondary transfer portion 12 again, so that an image is formed on the backside surface of the recording material. After passing through the fixing apparatus 100, the recording material is conveyed to the pair of discharge rollers 14. Finally, after passing through the pair of discharge rollers 14, the recording material P is discharged to a recording material P loading portion 16, which completes the duplex printing.

Although the full-color laser beam printer having the plurality of photosensitive drums 6 is described as an exemplary image forming apparatus, the invention is also applicable to a fixing apparatus for use in a monochrome copier or printer including a single photosensitive drum 6.

Fixing Apparatus

Figure 2:
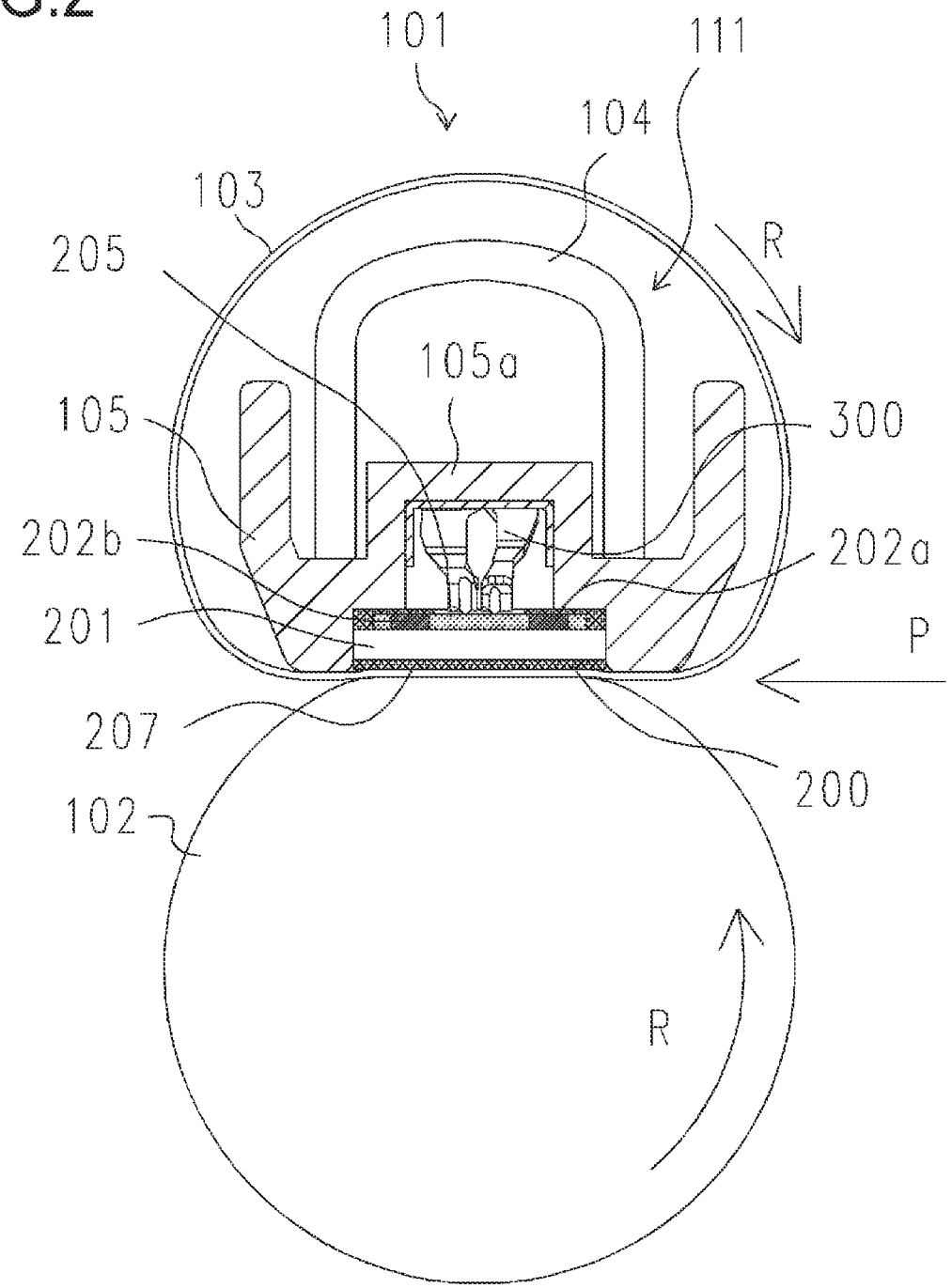
FIG. 2 is a sectional view of a fixing nip structure according to an embodiment of the present invention.
Figure 3:
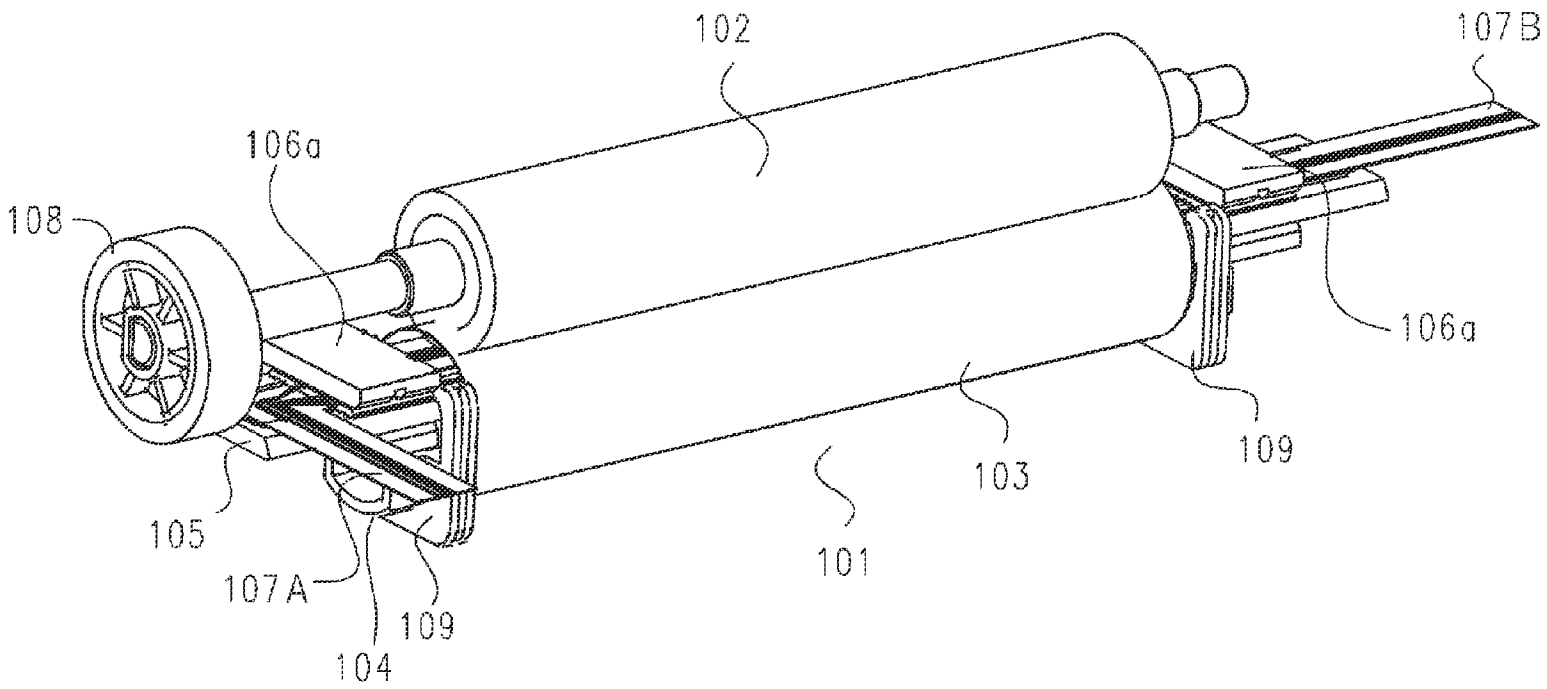
FIG. 3 is a perspective view of the fixing nip structure according to the embodiment of the present invention.

With reference to FIGS. 2 and 3, the fixing apparatus (the image heating apparatus) 100 according to the embodiment of the present invention will be described. FIG. 2 is a schematic sectional view of the fixing apparatus 100 having the heating unit 101 and the pressure roller 102, and FIG. 3 is a schematic perspective view of the fixing apparatus 100. The heating unit 101 includes a tubular film 103 as a first rotating member and a heater unit 111 in contact with the inner surface of the film 103.

The heater unit 111 includes a heater 200 in contact with the inner surface of the film 103 on a sliding surface layer 207, a heater holding member 105 which holds the heater 200, a metal stay member 104, and flange members 109 attached to the stay member 104 to support the opposed ends of the film in a rotatable manner. The heater 200 includes a substrate 201, a heat-generating member provided on the surface of the substrate 201 (hereinafter referred to as the backside surface) opposite to the surface facing the film 103, and the sliding surface layer 207 provided at the surface of the substrate 201 facing the film 103. Heat from the heat-generating member is transferred to the film 103 through the substrate 201 and the sliding surface layer 207. The heat-generating member includes a first heat-generating resistor 202*a* and a second heat-generating resistor 202*b*.

The pressure roller 102 as a second rotating member has an elastic layer made for example of a metallic core portion and silicone rubber. The flange members 109 and the stay member 104 are biased toward the pressure roller 102 by pressurizing unit (not shown), and the heater holding member 105 is biased toward the pressure roller 102 by this force.

More specifically, the heating unit 101 is biased toward the pressure roller 102, and the heating unit 101 and the pressure roller 102 form the fixing nip portion which sandwiches the conveyed recording material P therebetween. A driving member (gear) 108 provided at the end of the pressure roller 102 is driven to rotate by driving unit (a motor) which is not shown, so that the pressure roller 102 rotates. As the pressure roller 102 rotates, the film 103 is driven in the rotation direction R.

Heater

Figure 4A:
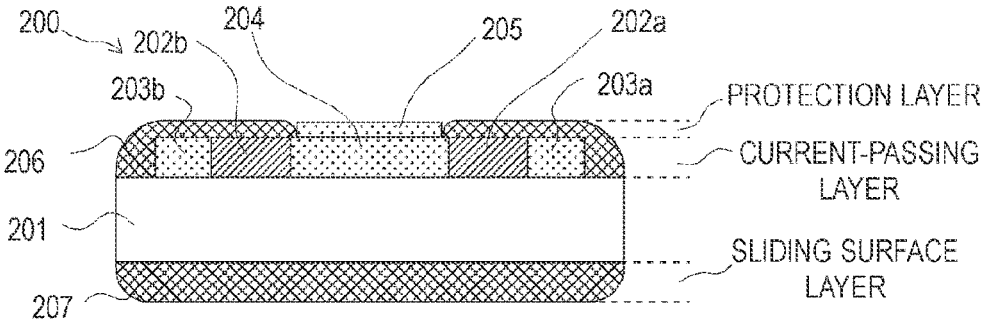
FIGS. 4A to 4E are views of a heater structure according to the embodiment of the present invention.

With reference to FIGS. 4A to 4E, the feature of the heater according to the embodiment will be described. FIG. 4A shows a section of the heater 200 when the heater 200 is viewed in the longitudinal direction of the heater 200 (the direction orthogonal to the direction in which the recording material P is conveyed). The heater 200 is heated by the first heat-generating resistor 202*a* and the second heat-generating resistor 202*b* provided at a current-passing layer on the ceramic substrate 201, the longitudinal direction of which is orthogonal to the direction in which the recording material P is conveyed. The current-passing layer is provided with a first conductor 203 and a second conductor 204 in the longitudinal direction of the heater. The first conductor 203 branches into 203*a* and 203*b* respectively upstream and downstream of the direction in which the recording material P is conveyed. The second conductor 204 is provided between the first heat-generating resistor 202*a* and the second heat-generating resistor 202*b*.

An insulating protection layer 206 covering the two heat-generating resistors 202*a* and 202*b* and the conductors 203 and 204 is provided at the backside surface of the heater 200. The sliding surface layer 207 of a coating for example of glass or polyimide having high slidability is provided on the sliding surface side (on the side of the surface opposed to the film 103) of the heater 200 on which the heater 200 and the film 103 slide on each other.

Figure 4B:
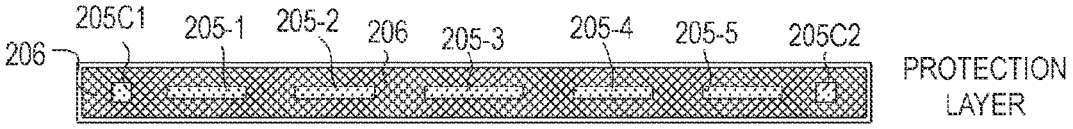
Figure 4C:
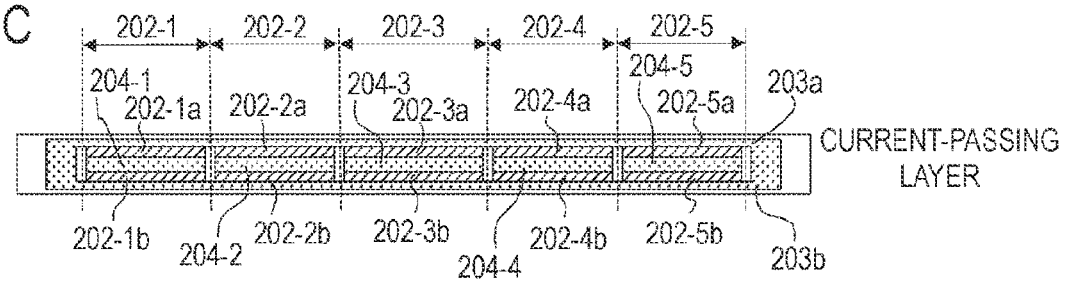
Figure 4D:
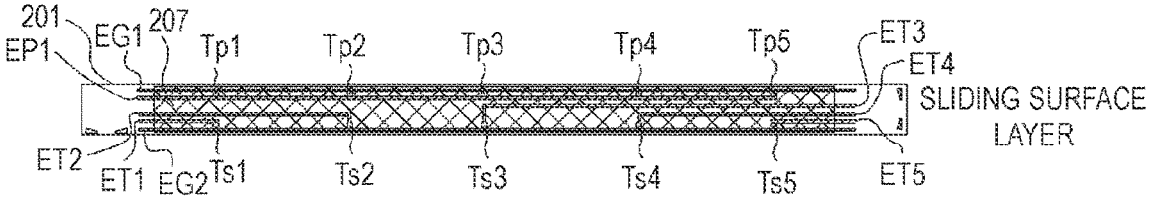

FIGS. 4B, 4C, and 4D are plan views of the layers (the protection layer in FIG. 4B, the current-passing layer in FIG. 4C, and the sliding surface layer in FIG. 4D) of the heater 200. A plurality of heat-generating blocks including the second conductor 204, the first heat-generating resistor 202*a*, and the second heat-generating resistor 202*b* are arranged in the longitudinal direction of the heater 200 in the current-passing layer of the heater 200. The heater 200 according to the embodiment has five heat-generating blocks in total in the longitudinal direction of the heater 200.

A first heat-generating block 202-1 includes a first heat-generating resistor 202-1*a* and a second heat-generating resistor 202-1*b* formed symmetrically with respect to the transverse direction of the heater 200, a conductor 204-1 as a part of the second conductor 204, and an electrode 205-1 which will be described. The second to fifth heat-generating blocks 202-2 to 202-5 are similarly formed.

The first conductor 203 is provided in the longitudinal direction of the heater 200 and includes the conductors 203*a* and 203*b*. The conductor 203*a* is connected to the first heat-generating resistors 202-*la*, 202-2*a*, 202-3*a*, 202-4*a*, and 202-5*a* of the heat-generating blocks. The conductor 203*b* is connected to the second heat-generating resistors 202-1*b*, 202-2*b*, 202-3*b*, 202-4*b*, and 202-5*b* of the heat-generating blocks.

Here, the conductor 203*a* as the first conductor electrically connects electrodes 205C1 and 205C2 and the upper ends of the first heat-generating resistors 202-*la* to 202-5*a* shown in FIG. 4C in the heat-generating blocks. The conductor 203*b* as the second conductor electrically connects the electrodes 205C1 and 205C2 and the lower ends of the second heat-generating resistors 202-1*b* to 202-5*b* shown in FIG. 4C in the heat-generating blocks. The second conductor 204 is divided into five conductors 204-1, 204-2, 204-3, 204-4, and 204-5 connected to the corresponding heat-generating blocks. The conductors 204-1 to 204-5 electrically connect electrodes 205-1 to 205-5 shown in FIG. 4B and the lower ends of the first heat-generating resistors 202-*la* to 202-5*a* shown in FIG. 4C. Similarly, the conductors 204-1 to 204-5 electrically connect the electrodes 205-1 to 205-5 and the upper ends of the second heat-generating resistors 202-1*b* to 202-5*b* shown in FIG. 4C.

The electrodes 205C1, 205C2, 205-1, 205-2, 205-3, 205-4, and 205-5 are provided on the same surface as the surface provided with the protection layer in order to supply power to the first heat-generating resistor 202*a* and the second heat-generating resistor 202*b*. The electrodes 205C1, 205C2, and 205-1 to 205-5 are provided and exposed at openings in the protection layer 206 shown in FIG. 4B. The electrode 205C1 as a first electric contact portion is provided near a longitudinal end of the substrate, and the electrode 205C2 as a second electric contact portion is provided near the other longitudinal end of the substrate. The electrodes 205C1 and 205C2 are common electrodes for supplying power to the five heat-generating blocks 202-1 to 202-5 through the conductors 203*a* and 203*b*. The electrodes 205-1 to 205-5, on the other hand, are electrodes for supplying power to the corresponding heat-generating blocks 202-1 to 202-5. The electrodes 205-1 to 205-5 provided between the electrodes 205C1 and 205C2 correspond to third electric contact portions in the heat-generating blocks. A contact member 300 connected to the power supply is allowed to contact the electrodes 205-1 to 205-5 for conduction to supply power to the first to fifth heat-generating blocks connected in parallel to the conductor 203*a* and the conductor 203*b*. The terminals of power supply connectors 106*a* are in contact with the electrodes 205C1 and 205C2 (see FIGS. 6 and 7).

When the power supply ratio to the divisional heat-generating blocks 202-1 to 202-5 of the heater 200 is varied, the temperature increase at the ends of a non-passing region may be reduced depending on the width size of the recording material P. For example, when fixing is performed to a recording sheet having a width corresponding to the heat-generating block 202-3, power supplied to the heat-generating block 202-3 is maintained, and power supplied to the other heat-generating blocks is lowered, so that the temperature increase at the ends of the non-passing region may be reduced.

Temperature Detection Configuration

Figure 4E:
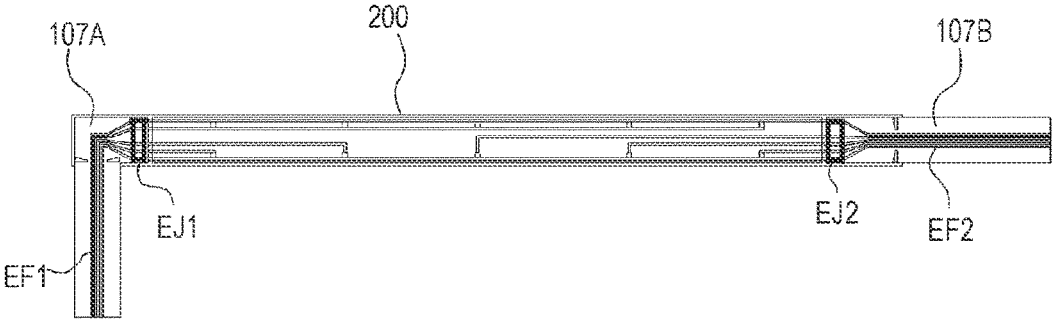

With reference to FIG. 4D, the feature of the temperature detection configuration according to the embodiment will be described. At the sliding surface layer of the heater 200, thermistors Tp1 to Tp5 and Ts1 to Ts5 as temperature detecting elements are provided in the heat-generating blocks. These thermistors each detect the temperature of a corresponding heat-generating block, and power supplied to the heat-generating blocks is controlled. A conductor connected to each of the thermistors is also formed at the sliding surface layer of the heater 200. Conductors EG1 and EG2 are connected to the thermistors Tp1 to Tp5 and Ts1 to Ts5 on one end side and to the ground potential of the thermistor temperature detecting unit of the control circuit. Conductors ET1 to ET5 are connected to the thermistors Ts1 to Ts5, respectively and are formed to extend to the longitudinal ends of the heater 200. A conductor EP1 is connected to the ends of the thermistor Tp1 to Tp5 which are not connected to the conductor EG1. A protection glass is formed at the sliding surface layer 207 excluding the longitudinal ends of the heater 200. A part of each of the conductors not covered by the protection glass serves as an electrode which connects to a flexible sheet 107 as a sheet member. FIG. 4E shows the flexible sheet 107 bonded to electrodes at the ends of the heater. Conductor patterns EF1 and EF2 identical to the conductors connected to the thermistors are formed at the flexible sheet 107, and the flexible sheet 107 is soldered to the contacts at the heater ends to overlap a part of the heater (solder joints EJ1 and EJ2).

Extending Direction of Flexible Sheet Bonded to Heater

Now, the direction in which the flexible sheet 107 bonded to the heater 200 extends as the feature of the embodiment will be described.

As shown in FIG. 3, the flexible sheet 107 bonded to the heater 200 includes a flexible sheet 107A as a first sheet member on the side with the driving gear (hereinafter referred to as the driving side) and a flexible sheet 107B as a second sheet member on the opposite side (hereinafter referred to as the anti-driving side). The flexible sheet 107A on the driving side is electrically connected to one end side of the heater 200 in the longitudinal direction. More specifically, the flexible sheet 107A is arranged to overlap a part of one end of the heater 200 and electrically connected to one end of the heater 200 and extends from the end in a direction substantially orthogonal to the longitudinal direction of the heater. The flexible sheet 107B on the anti-driving side is electrically connected to the other end of the heater 200 in the longitudinal direction. More specifically, the flexible sheet 107B is arranged to overlap a part of the other end of the heater 200 and electrically connected to the other end of the heater 200 and extends from the other end in the same direction as the longitudinal direction of the heater.

Since the heater 200 is in the vicinity of the pressure roller 102 through the film 103, the flexible sheet 107A on the driving side may contact the driving gear 108 when the sheet extends in the longitudinal direction of the heater. In order to extend the flexible sheet 107A on the driving side in the heater longitudinal direction, if the driving gear 108 is provided apart from the heater 200 and the flexible sheet 107 to avoid contact with the sheet, the size of the apparatus can be increased.

Therefore, the flexible sheet 107A on the driving side extends in a direction crossing the longitudinal direction of the heater. According to the embodiment, the flexible sheet 107A on the driving side is extended substantially orthogonally to the longitudinal direction, but similar effects can be obtained by other kinds of arrangement. More specifically, the extending direction of the flexible sheet 107A on the driving side may be changed for an angle different from the right angle with respect to the longitudinal direction of the heater. For example, the flexible sheet 107 may be configured to extend in a direction which crosses the heater 200 as appropriate so that the sheet does not contact the driving gear 108.

Figure 5:
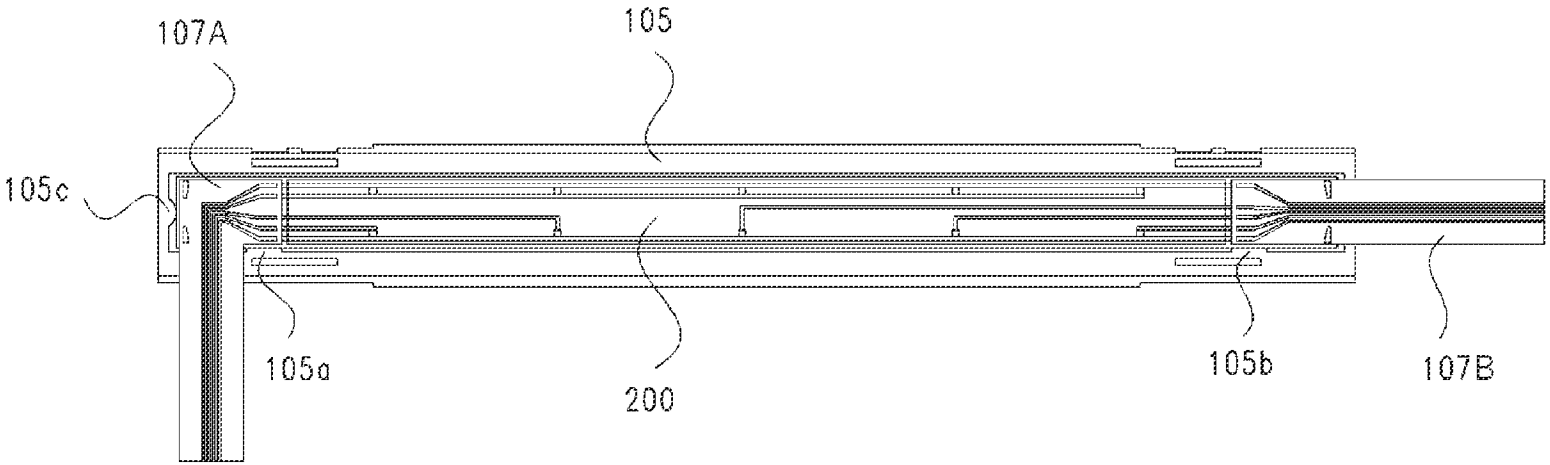
FIG. 5 is a perspective view of a heater fixed to a heater holding member.

FIG. 5 is a top view of the heater 200 fixed to the heater holding member 105. When the heater 200 is misaligned with respect to the recording material P, the heating region by the heating unit 101 is misaligned with respect to the toner image on the recording material P, and a part of the toner image cannot be fixed. When the relative positions of the heating region and the recording material P are misaligned, a temperature difference occurs between the opposed ends of the pressure roller, and the recording material P cannot be stably conveyed. Therefore, the heater 200 is held in the heater holding member 105 while being abutted against abutment portions 105*a*, 105*b*, and 105*c* provided at the heater holding member 105 at three locations, i.e., the downstream ends in the conveying direction at the opposed ends of the heater in the heater longitudinal direction and the heater end on the driving side in the heater longitudinal direction. Also, a silicone rubber heat resistant adhesive is applied between the backside surface of the heater and the heater holding member 105 to secure the heater 200 to the heater holding member 105. During the manufacture of the apparatus, when the heater abutment portions 105*a*, 105*b*, and 105*c* are covered with the flexible sheet 107, the abutment portions 105*a*, 105*b*, and 105*c* may not be visible and the heater 200 may not be surely abutted against the heater holding member 105. Therefore, the heater 200 is abutted against the abutment portion 105*c* so that the abutment portion 105*a* is not covered with the flexible sheet 107. The heater 200 is abutted against the abutment portion 105*c* to ensure at least positioning of the heating region in the longitudinal direction of the heater.

Figure 6:
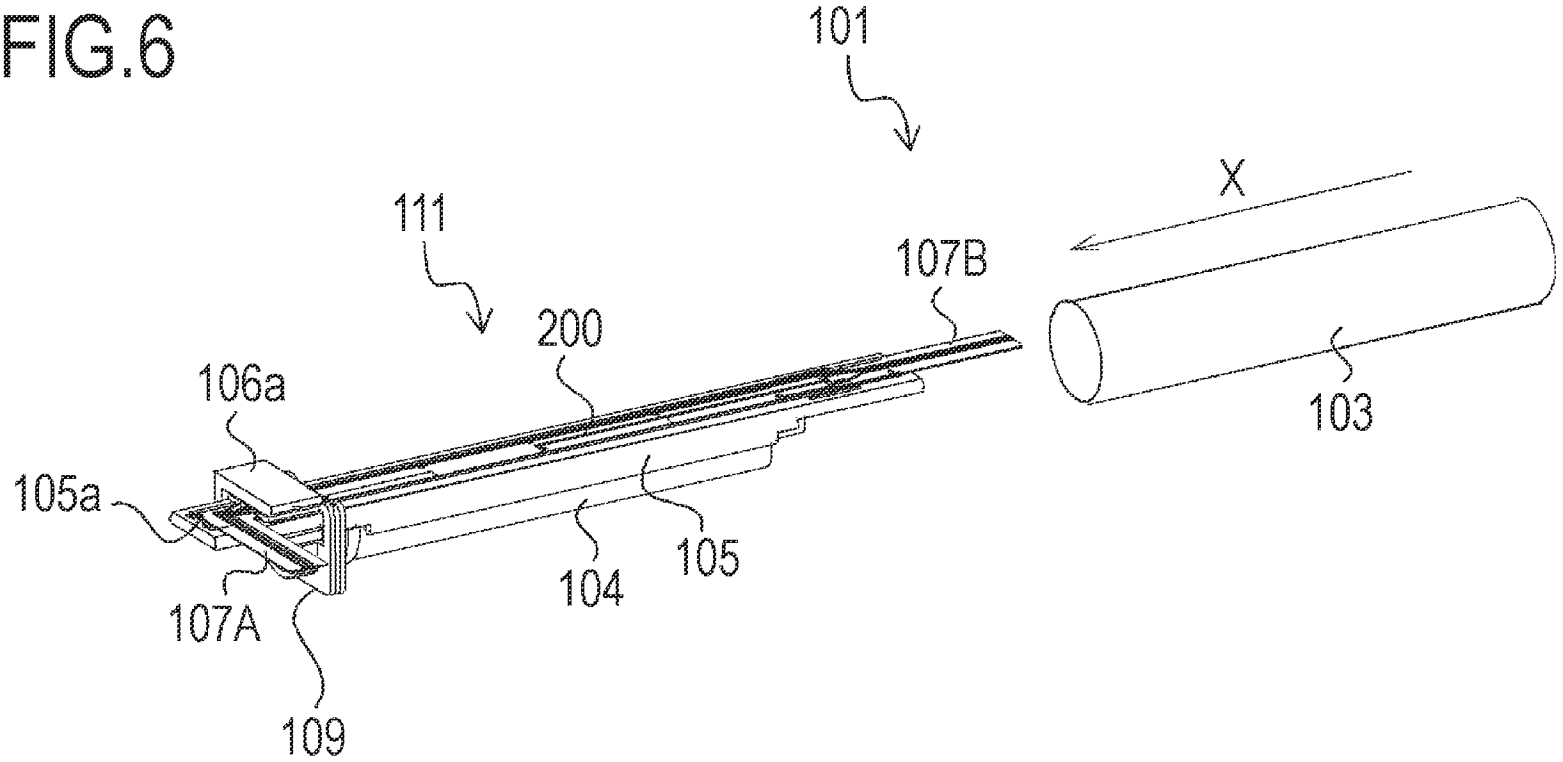
FIG. 6 is a perspective view for illustrating how a heater unit is inserted into a film.

FIG. 6 is a schematic view for illustrating how the internal components of heater unit 111 are inserted into the film 103. When the heating unit 101 is assembled, the internal components such as the heater 200 attached with the flexible sheet 107, the heater holding member 105, and the stay member 104 are inserted into the inside part (the inner tubular part) of the film 103. At the time, when it is attempted to insert the internal components into the film 103 from the flexible sheet 107A on the driving side extending in a direction crossing the longitudinal direction of the heater, the flexible sheet 107A on the driving side must be bent to fit into the cross-sectional area of the inside part of the film 103. In the case, the film 103 and the flexible sheet 107A may be creased and damaged. Therefore, the internal components are preferably inserted into the film 103 starting from the flexible sheet 107B on the anti-driving side extending in the longitudinal direction of the heater. Since the longitudinal direction of the film 103 and the direction in which the flexible sheet 107B on the anti-driving side extends are the same, the flexible sheet 107B can be inserted along the cylindrical shape of the film 103 without causing damage or the like.

Figure 7:
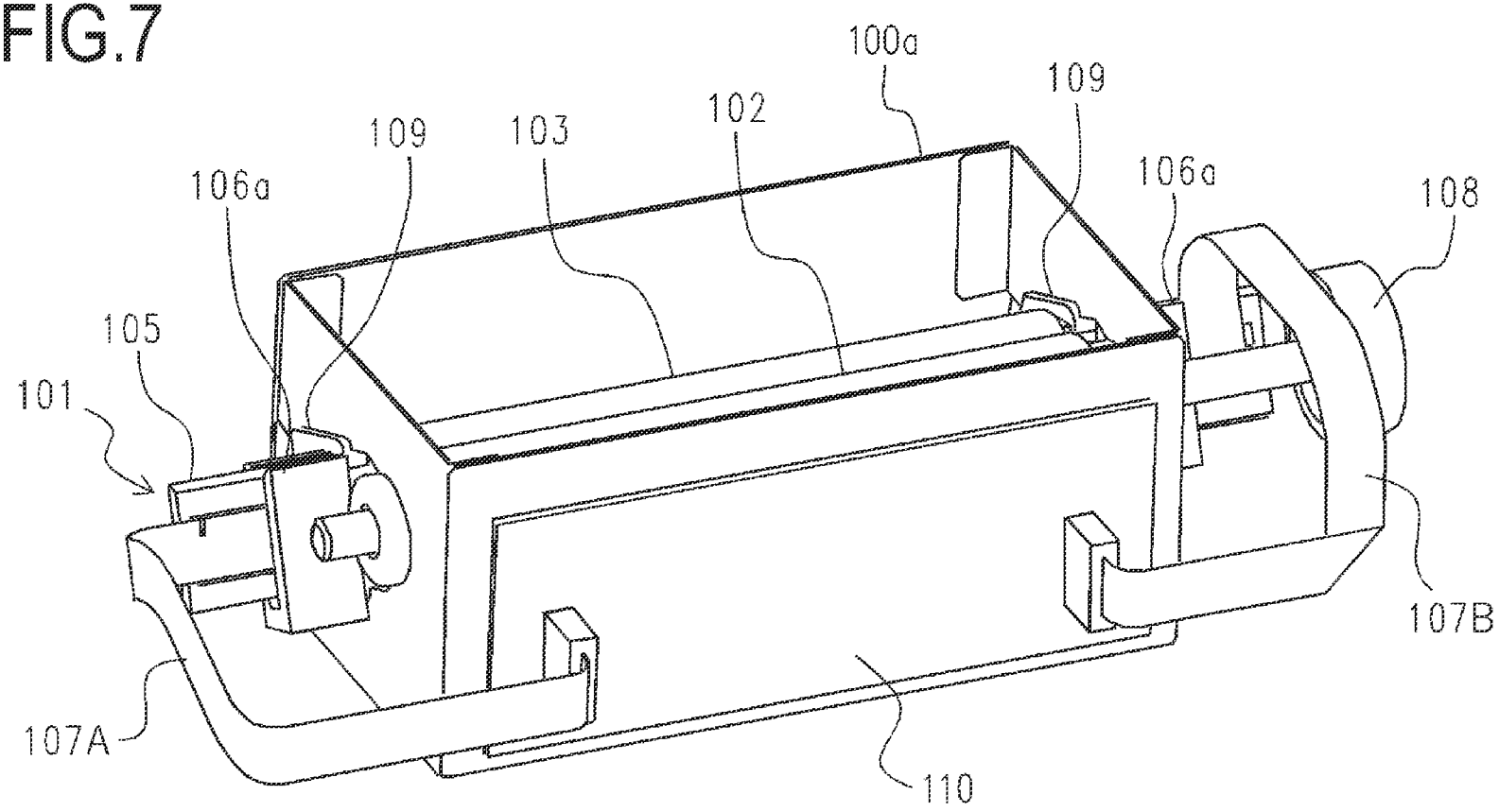
FIG. 7 is a schematic perspective view of a fixing apparatus according to the embodiment of the present invention.

As shown in FIG. 7, the heating unit 101 having the heater unit 111 inserted in the film 103 and the pressure roller 102 are mounted to a frame 100*a* of the fixing apparatus 100. The flexible sheets 107A and 107B each extending toward the driving and the anti-driving sides are electrically connected to an electrical substrate 110 provided at the frame 100*a*.

As in the foregoing, the flexible sheet 107A on the driving side extends in a direction crossing the longitudinal direction of the heater in order to prevent contact between the sheet and the driving gear 108 and to surely fix the heater 200 to the heater holding member 105 by abutment. The flexible sheet 107B on the anti-driving side extends in the longitudinal direction of the heater to prevent damage during insertion into the film 103. In this way, the apparatus can be reduced in size without damaging the components during assembly of the fixing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-079239, filed on Apr. 28, 2020, which is hereby incorporated by reference herein in its entirety.

What is claimed is:

1. An image heating apparatus for heating an image formed on a recording material, comprising:

a first rotating member;

a second rotating member provided in contact with an outer surface of the first rotating member to form a nip portion which sandwiches the recording material between the first rotating member and the second rotating member;

a heater unit provided inside the first rotating member and having a heater for heating the image formed on the recording material sandwiched by the nip portion; and a flexible sheet member including a flexible printed circuit or a flexible flat cable provided to overlap a part of the heater and electrically connected to the heater, wherein the flexible sheet member includes a first flexible sheet member connected to one end of the heater in a longitudinal direction of the heater and a second flexible sheet member connected to the other end of the heater, wherein the first flexible sheet member extends from the one end of the heater along a direction crossing the longitudinal direction, and wherein the second flexible sheet member extends from the other end of the heater along the longitudinal direction.

2. The image heating apparatus according to claim 1, further comprising a driving member for driving the first rotating member and the second rotating member to rotate, wherein the driving member is provided on a side of the one end of the heater in the longitudinal direction.

3. The image heating apparatus according to claim 1, wherein the heater unit further comprises a heater holding member which holds the heater, and wherein the heater holding member comprises an abutment portion against which the heater is abutted in the longitudinal direction on a side of the one end.

4. The image heating apparatus according to claim 1, wherein the direction in which the first flexible sheet member extends is a direction orthogonal to the longitudinal direction.

5. The image heating apparatus according to claim 1, wherein the longitudinal direction is a direction orthogonal to a direction in which the recording material is conveyed at the nip portion.

6. The image heating apparatus according to claim 1, wherein the first rotating member is a tubular film having an inner surface with which the heater unit is in contact, wherein the second rotating member is a pressure roller, and wherein the heater and the pressure roller sandwich the film therebetween to form the nip portion.

7. The image heating apparatus according to claim 1, wherein the heater has a substrate having a longitudinal direction which is orthogonal to a direction in which the recording material is conveyed at the nip portion and a plurality of heat-generating resistors arranged in the longitudinal direction of the substrate.

8. The image heating apparatus according to claim 7, wherein the heater has a plurality of temperature detecting elements arranged in the longitudinal direction of the substrate, and wherein the first flexible sheet member and the second flexible sheet member are electrically connected to the plurality of temperature detecting elements.

9. The image heating apparatus according to claim 8, wherein the first flexible sheet member and the second flexible sheet member are electrically connected to the plurality of temperature detecting elements by solder.

10. An image forming apparatus comprising:

an image forming portion which forms an image on a recording material, the image forming portion including a photosensitive member, a charging device for charging the photosensitive member, a scanner unit for scanning the photosensitive member with light in accordance with image information, a developing device for developing an electrostatic latent image formed on the photosensitive member with toner, and a transfer unit for transferring the image to the recording material; and a fixing portion which fixes an image, formed by the image forming portion, on the recording material, wherein the fixing portion is the image heating apparatus according to claim 1.

11. An image heating apparatus for heating an image formed on a recording material, comprising:

a first rotating member;

a heater provided in an inner space of the first rotating member;

a second rotating member provided in contact with an outer surface of the first rotating member, the second rotating member forming a nip portion for sandwiching the recording material between the first rotating member and the second rotating member in cooperation with the heater through the first rotating member;

a first flexible printed circuit electrically connected to the heater at a first position of the heater in a longitudinal direction of the heater, a second flexible printed circuit electrically connected to the heater at a second position different from the first position of the heater in the longitudinal direction of the heater, wherein the first flexible printed circuit extends from one end of the heater in the longitudinal direction of the heater along a direction crossing the longitudinal direction of the heater, and wherein the second flexible printed circuit extends from the other end of the heater in the longitudinal direction of the heater along the longitudinal direction of the heater.

12. The image heating apparatus according to claim 11, wherein the second rotating member includes a gear receiving a driving force from a motor, wherein, in the longitudinal direction of the heater, the gear is provided at one end of the second rotating member on the same side as the side where the one end of the heater is provided.

13. The image heating apparatus according to claim 11, further comprising a heater holding member provided in the inner space of the first rotating member and holding the heater along the longitudinal direction, wherein, in the longitudinal direction, one end of the heater holding member is provided with an abutment portion for abutting the one end of the heater.

14. The image heating apparatus according to claim 13, wherein, when viewed from the second rotating member in a direction perpendicular to the longitudinal direction, the abutment portion is provided so as not to be covered with the first flexible printed circuit.

15. The image heating apparatus according to claim 11, wherein the heater includes a first temperature detecting element and a second temperature detecting element, and wherein the first flexible printed circuit is electrically connected with the first temperature detecting element and the second flexible printed circuit is electrically connected with the second temperature detecting element.

16. The image heating apparatus according to claim 15, wherein the heater includes a substrate, a first heat-generating resistor provided on the substrate, and a second heat-generating resistor provided on the substrate at a position different from a position where the first heat-generating resistor is provided in the longitudinal direction of the heater, and wherein, in the longitudinal direction, the first temperature detecting element is provided at a position where the first heat-generating resistor is provided, and the second temperature detecting element is provided at a position where the second heat-generating resistor is provided.

17. The image heating apparatus according to claim 11, wherein the first and second flexible sheet members are electrically connected to the plurality of temperature detecting elements by solder.

18. The image heating apparatus according to claim 11, wherein the first rotating member is a tubular film, and wherein the second rotating member is a pressure roller.

19. An image forming apparatus comprising:

an image forming portion which forms an image on a recording material, the image forming portion including a photosensitive member, a charging device for charging the photosensitive member, a scanner unit for scanning the photosensitive member with light in accordance with image information, a developing device for developing an electrostatic latent image formed on the photosensitive member with toner, and a transfer unit for transferring the image to the recording material; and a fixing portion which fixes an image, formed by the image forming portion, on the recording material, wherein the fixing portion is the image heating apparatus according to claim 11.

* * * * *